US005722496A

United States Patent [19]

Connell et al.

[11] Patent Number: 5,722,496

[45] Date of Patent: Mar. 3, 1998

[54] REMOVABLE GUIDE MEMBER FOR GUIDING DRILL STRING COMPONENTS IN A DRILL HOLE

[75] Inventors: Stuart A. Connell, Buchanan; James C. Patsell, Goodview; James T. Laub, Salem, all of Va.

[73] Assignee: Ingersoll-Rand Company, Woodcliff Lake, N.J.

[21] Appl. No.: 620,682

[22] Filed: Mar. 19, 1996

[51] Int. Cl.[6] ..... F21B 17/10

[52] U.S. Cl. ..... 175/325.5

[58] Field of Search ..... 175/325.1, 325.2, 175/374

[56] References Cited

U.S. PATENT DOCUMENTS

| | | | |
|---|---|---|---|
| 3,420,323 | 1/1969 | Owens | 175/325.2 X |
| 3,851,719 | 12/1974 | Thompson et al. | 175/325.2 X |
| 3,923,324 | 12/1975 | Cruickshank et al. | 175/325.2 X |
| 3,945,446 | 3/1976 | Ostertag et al. | 175/325.2 X |
| 3,948,575 | 4/1976 | Rosser | 175/325.2 |
| 4,245,708 | 1/1981 | Cholet et al. | 175/325.2 |
| 5,474,143 | 12/1995 | Majkovic | 175/325.2 X |

OTHER PUBLICATIONS

Sandvick Product Catalogue dated Aug. 1, 1989.

*Primary Examiner*—William P. Neuder
*Attorney, Agent, or Firm*—John J. Selko

[57] ABSTRACT

A removable guide member for guiding drill string components in a drill hole includes and elongated body having a centerline axis with a bore extending along the axis. The body terminates in a head end having a preselected radial dimension with respect to the centerline axis. The guide member is adapted to be threadably connected to adjoining drill string components. The head end radial dimension is preselected to space an outer surface thereof in close proximity to a drill hole sidewall, so that if the drill string begins to deviate out of alignment, the outer surface of the head end will contact the drill hole sidewall to stabilize alignment. The guide member can be inserted into any position along the drill string.

5 Claims, 3 Drawing Sheets

REMOVABLE GUIDE MEMBER FOR GUIDING DRILL STRING COMPONENTS IN A DRILL HOLE

BACKGROUND OF THE INVENTION

This invention relates generally to the connection of drill string components used in percussive drilling and more particularly to guide members inserted into a drill string for aligning the drill string within a drill hole, as the drill bit advances the drill string therein.

In drilling a hole in construction and mining, it is necessary to connect drill rod to a threaded bit used to drill the hole. For blasthole and other construction applications, a straight hole is very important.

The typical bit and rod connection is a drill rod with male threads screwed into a threaded bit with female threads. Since the face of the bit is the actual cutting part of the bit, the bit follows the path of least resistance as it travels through formations of varying characteristics, and there is nothing guiding the drill string and the hole direction.

The drill string tends to bend as it follows the bit, and bending loads are resisted by the drill string components, causing the life of the components to suffer.

Prior art guide bits have been used to try to solve the problem of hole deviation. These prior art bits are individual standalone items of equipment that the driller must carry as added equipment. The insertion of the bit requires the withdrawal and removal of the standard bit because these prior art bits can only be inserted on the front end of the drill string. They cannot be inserted into a position in the middle of a drill string length.

The foregoing illustrates limitations known to exist in present guide bits. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a removable guide member for guiding drill string components in a bore being produced by a percussive, down the hole drill comprising: an elongated body having a centerline axis extending therealong; a bore extending along said centerline axis, for passing a fluid therethrough; said body terminating in a shank end portion, said shank end portion having a shank radial dimension, as measured from said centerline axis; said body terminating in a head end portion, said head end portion having a head radial dimension, as measured from said centerline axis; said head radial dimension being greater than said shank radial dimension; means on said shank end portion for removably connecting to a first drill string component; and means on said head end for removably connecting to a second drill string component.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
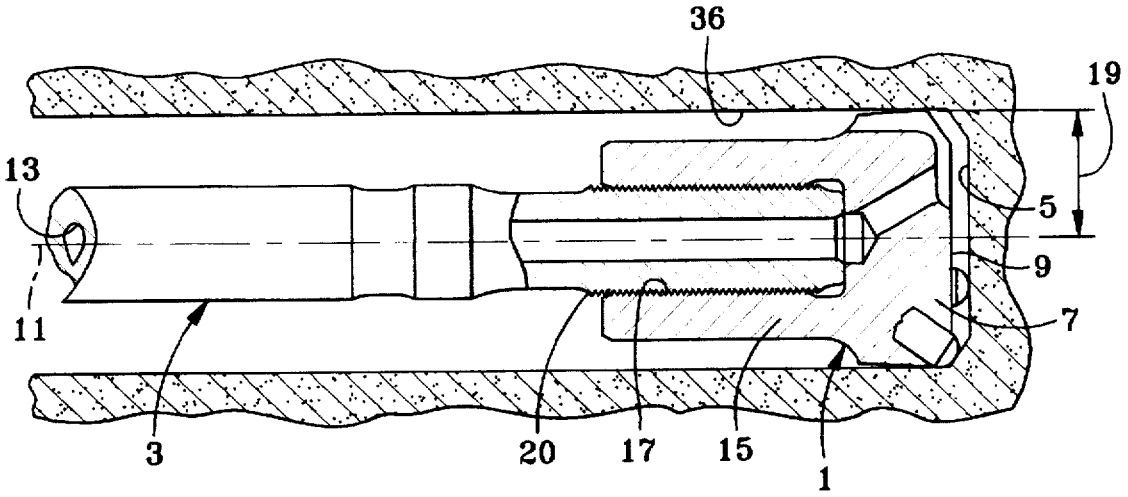
FIG. 1 (PRIOR ART)
FIG. 1 shows a schematic view, partially in cross section, of a prior art drill bit and drill rod connection in a drill hole.

Now referring to FIG. 1, the prior art drill bit 1 and rod 3 are shown connected and positioned in a drill hole 5, as is conventional for percussive drilling. As used herein, the term "percussive drilling" means that the bit 1 is rotated by a top head (not shown) and subjected to impact waves from a hammer (not shown) at the top end of the drill string. Bit 1 has a bit head 7 with a bit face 9 that cuts the material being drilled. A drill string centerline 11 has a bore 13 extending therealong for carrying a fluid that exits out of bit 1 to drive drill hole debris out of the drill hole 5 via the annulus surrounding the drill string.

Bit 1 includes a stem portion 15 having an internal bore therein with female threads 17 for receiving a male end 20 of an adjoining drill rod 3. Bit 1 has a radial dimension 19, with respect to centerline axis 11. Drill rod 3 has male threads on each end for connection to drill bit 1 or to a coupling (not shown) as is well known. If bit face 9 encounters material of variable cutting characteristics, it follows the path of least resistance, tending to cause drill hole deviation.

Figure 2:
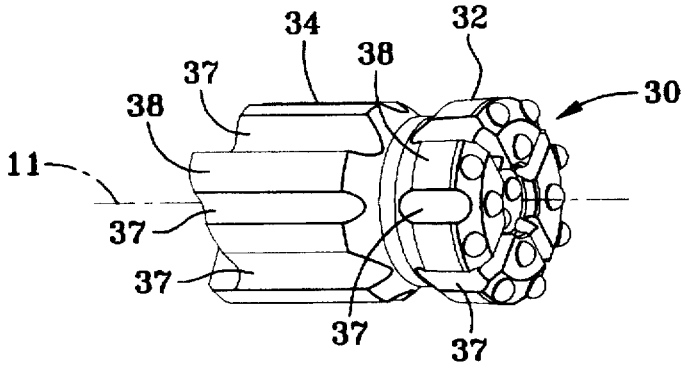
FIG. 2 (PRIOR ART)
FIG. 2 shows an isometric view of a prior art guide bit.

To resist drill hole deviation, operators use the prior art guide drill bit 30, shown in FIG. 2. Bit 30 has a head portion 32 and a stem portion 34 of radial dimension about the same as the head portion 30, with respect to centerline axis 11, so as to contact the sidewalls 36 (FIG. 1) of a drill hole 5 to resist deviation. A plurality of spaced apart undercut portions 36 extend axially along outer surface 38 of bit head 32 and stem 34, to provide flow passageways for drill hole debris. Bit 30 can only be inserted into the drill string at the front end thereof.

Figure 3:
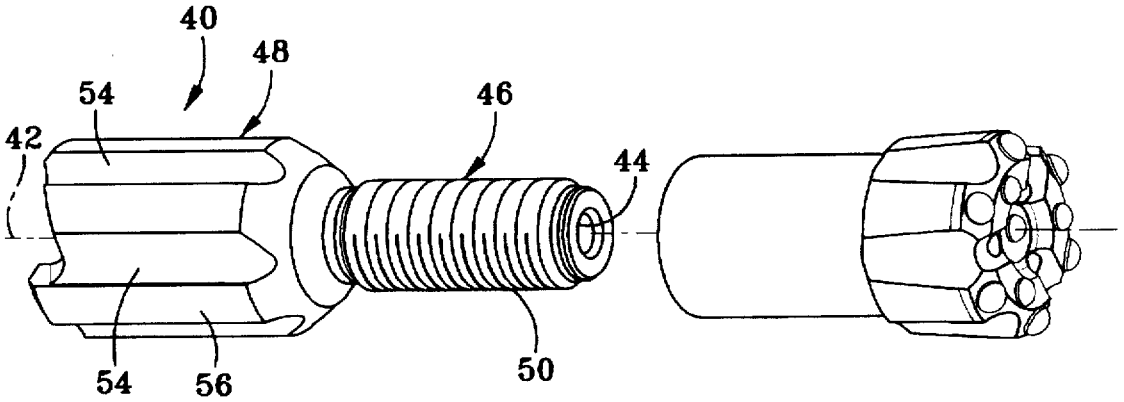
FIG. 3 shows an isometric view of the guide member of this invention and a typical drill bit therewith.

FIG. 3 shows an isometric schematic view of the universal guide member of this invention. The guide member has an elongated body 40 having a body centerline axis 42 extending axially therealong. A bore 44 extends along body centerline axis 42 for passing fluid therethrough. Body 40 terminates in a shank end 46 and head end 48. Connection means 50 on shank end 46 removably connect shank end 46 to an adjoining drill string component. Connection means 52 (FIGS. 4 and 5) on head end portion 48 removably connect head end 48 to an adjoining drill string component. A plurality of spaced apart undercut portions 54 extend axially along outer surface 56 of head end portion 48, to provide flow passageways for drill hole debris.

Figure 4:
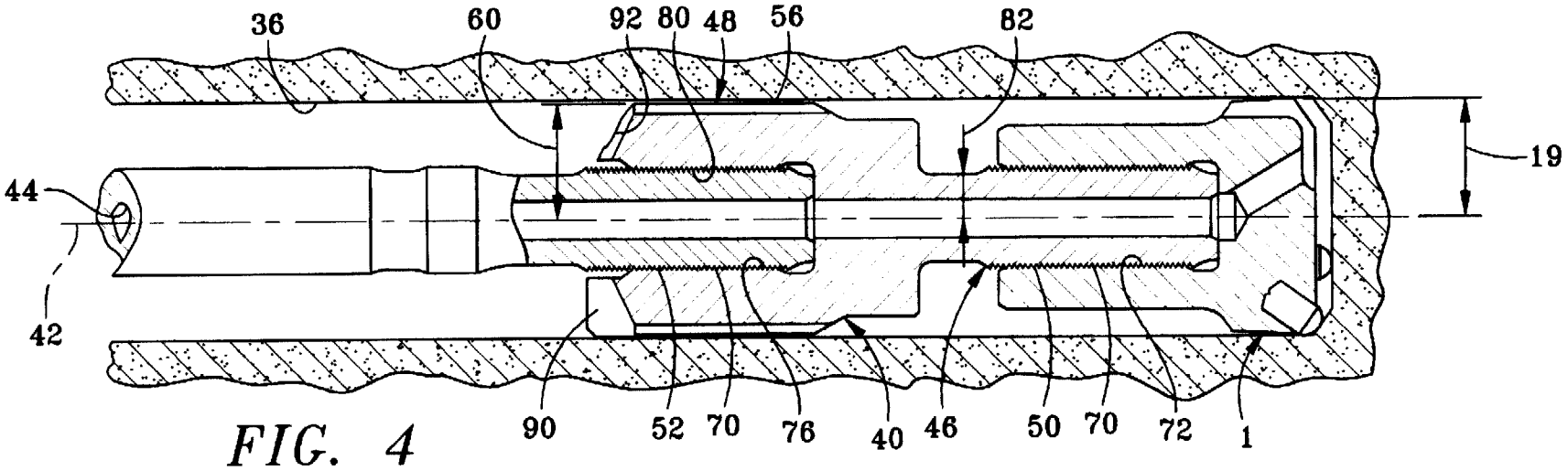
FIG. 4 shows a schematic view, partially in cross section, of the guide member of this invention connected to a drill bit in a drill hole.

Referring to FIG. 4, head end portion 48 has a preselected radial dimension 60, with respect to body centerline 42, radial dimension being chosen to be slightly smaller than a radial dimension 19 of a drill bit, so that when guide member 40 and drill bit 1 are inserted into a drill string, head end radial dimension 60, being smaller than drill bit radial dimension 19 will position an outer surface 62 of head end portion 48 in close proximity to a drill hole sidewall 36, whereby if the drill string begins to deviate substantially out of axial alignment, outer surface 62 will contact the drill hole 64, stabilizing alignment. The clearance provided by radial dimension 60 avoids contact with the drill hole sidewall 36 during periods of proper drill string alignment, reducing the powere demand of the drillin equipment. We prefer a clearance of 0.152 to 0.189 inches on diameter.

Connection means 50 on shank end portion 46 forms a male threaded member 70 for insertion into and threadably connecting to female threaded portion 72 on an adjoining drill string member. Connection means 52 on head end portion 48 forms a female threaded portion 76 for receiving therein and threadably connecting to male member 70 of an adjoining drill string component. Female portion 76 is formed in a bore 80 of larger diameter than bore 44. Shank end portion has a radial dimension 82 with respect to centerline 13 that is smaller than the corresponding radial dimension 60 of head portion 48.

Head end portion 48 terminates in an annular distal surface 90 that is machined into an angled cutting lip 92, whereby, when guide 40 is withdrawn upwardly form a drill hole 64, cutting lip 92 will cut through any drill hole debris that may be trapped thereabove.

Figure 5:
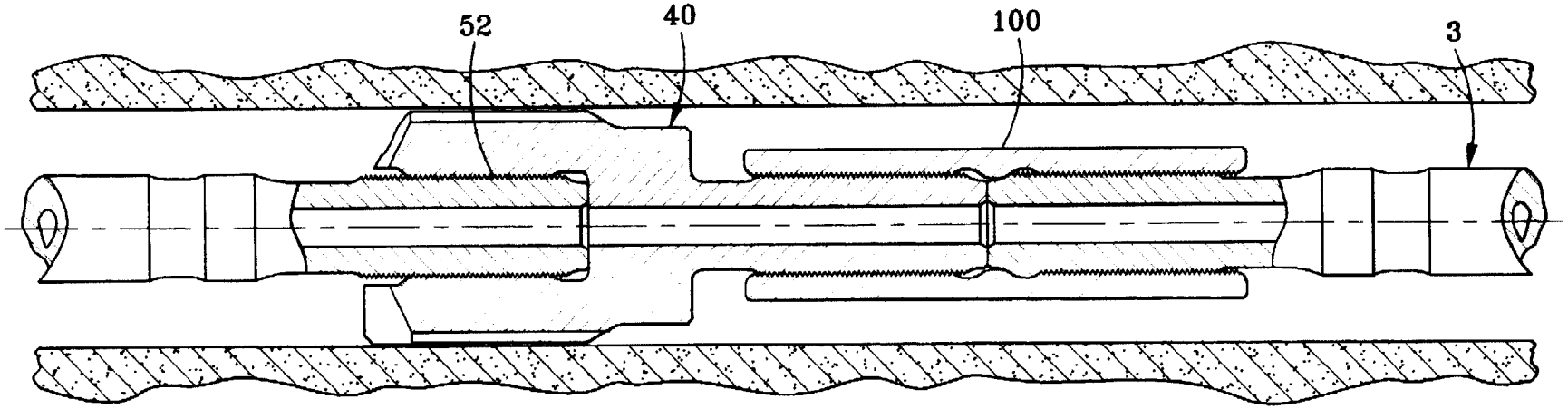
FIG. 5 shows a schematic view, partially in cross section, of the guide member of this invention inserted into a drill string between two drill rods.
Figure 6:
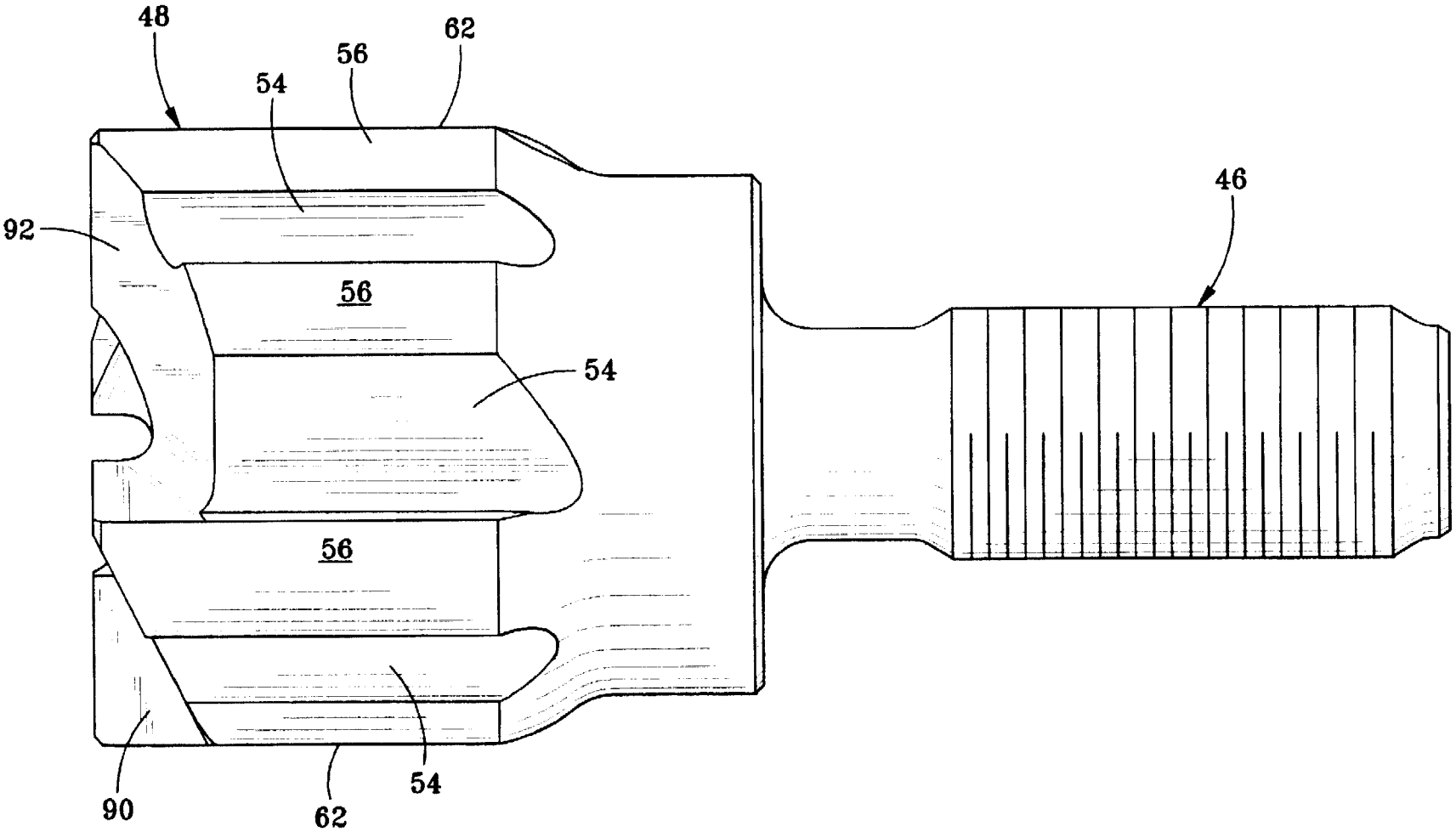
FIG. 6 show a schematic side view, with parts removed, of the guide member of this invention, showing more clearly the distal surface having an angled cutting lip.

FIG. 5 shows the universal characteristic of guide member 40, whereby the guide 40 can be placed at intermediate positions along the drill string, connecting to a coupling 100 on one end and to a drill rod 3 on the other.

Having described the invention, what is claimed is:

1. A guide member for maintaining alignment in a drill hole of drill string components along a drill string centerline, the drill hole being produced by a percussive, fluid-actuated drill bit, the drill bit having a radial dimension with respect to the drill string centerline, comprising:

(a) an elongated body having a body centerline axis extending axially therealong;

(b) a bore extending along said body centerline axis, for passing a fluid therethrough;

(c) said body terminating in a shank end portion and a head end portion;

(e) connection means on said shank end portion for removably connecting to a first drill string component;

(f) connection means on said head end portion for removably connecting to a second drill string component;

(g) said head end portion having an outer surface thereon substantially symmetrically spaced around said body centerline, said head end portion having a radial dimension with respect to said body centerline, such that when said guide member and a drill bit are inserted into a drill string, said head end radial dimension is less than a drill bit radial dimension, but sufficient to position said outer surface of said head end portion in close proximity to a drill hole sidewall, whereby, if the drill string begins to deviate substantially out of axial alignment, said outer surface will contact the drill hole sidewall; and (h) said head end portion terminating in a distal surface having an angled cutting lip, whereby, when said guide is withdrawn upwardly from a drill hole, said cutting lip will cut through drill hole debris that may be trapped thereabove.

2. The guide member of claim 1 wherein said connection means on said shank end portion forms a male threaded member for insertion into and threadably connecting to a female threaded portion of an adjoining drill string component.

3. The guide member of claim 2 wherein said connection means on said head end portion forms a female threaded portion for receiving therein and threadably connecting to a male threaded member of an adjoining drill string component.

4. The guide member of claim 3 wherein said outer surface of said body contains a plurality of spaced apart undercut portions extending axially along said body portion, to provide flow passageways for flow therethrough of drill hole debris.

5. The guide member of claim 4 wherein said shank end portion has a radial dimension with respect to said body centerline that is less than said radial dimension of said head end portion.

* * * * *